US006092405A

United States Patent [19]

Berwick

[11] Patent Number: 6,092,405

[45] Date of Patent: Jul. 25, 2000

[54] KEYRING TOOL

[76] Inventor: Melville Berwick, 33 Hawksmuir, Kirkcaldy, Fife, KY1 2PW, United Kingdom

[21] Appl. No.: 09/266,097

[22] Filed: Mar. 10, 1999

[51] Int. Cl.[7] ..... E05B 19/04; A44B 15/00

[52] U.S. Cl. ..... 70/408; 70/456 R; 70/457; 70/458

[58] Field of Search ..... 70/408, 407, 456 R, 70/457, 458; D3/207, 208, 210

[56] References Cited

U.S. PATENT DOCUMENTS

| | | | |
|---|---|---|---|
| 180,255 | 7/1876 | Miller | 70/491 X |
| D. 310,743 | 9/1990 | Riddle | D32/46 |
| D. 311,980 | 11/1990 | Baker | D32/46 |
| D. 357,051 | 4/1995 | Strenkowski | D22/117 |
| D. 367,343 | 2/1996 | Wise | D32/42 |
| D. 389,624 | 1/1998 | Drimmie et al. | D32/46 |
| 4,312,128 | 1/1982 | Olsen | 70/456 R X |
| 4,325,273 | 4/1982 | Gibbons | 81/3 R |
| 4,543,860 | 10/1985 | Van Meter | 70/456 R X |
| 4,706,477 | 11/1987 | Rousseau | 70/456 R |
| 4,719,778 | 1/1988 | Murphy et al. | 70/456 R |
| 4,790,161 | 12/1988 | Dick | 70/458 X |
| 5,373,717 | 12/1994 | Gore et al. | 70/45 RR |
| 5,713,232 | 2/1998 | Hodge | 70/456 R |
| 5,722,277 | 3/1998 | Williams | 70/456 R |

FOREIGN PATENT DOCUMENTS

| | | | |
|---|---|---|---|
| 504473 | 7/1920 | France | 70/491 |
| 1163526 | 9/1958 | France | 70/156 |
| 304491 | 3/1918 | Germany | 70/408 |
| 346349 | 4/1920 | Germany | 70/156 |
| 13109 | 7/1904 | Norway | 70/156 |
| 2175532A | 12/1986 | United Kingdom . | |

*Primary Examiner*—Lloyd A. Gall
*Attorney, Agent, or Firm*—Young & Basile

[57] ABSTRACT

The present invention relates to a keyring tool 1 suitable for storage on an expandable coil-type keyring 2 and disconnection therefrom which is used in connecting and disconnecting keys to and from the keyring 2. The keyring tool 1 comprises a bow portion 3 for connection of the tool 1 to the keyring 2 wherein the bow portion 3 has at least one circumferentially extending portion 5 having a generally wedge shaped-section extending from one side of the circumferentially extending portion 5 towards an opposite side thereof for insertion between one end 13, 19 of the coiled strip 14 of the keyring coil 2 and an axially adjacent part 15 of the coiled strip 14 for threading of the strip 14 through the bow portion 3 for connection or disconnection of the keyring tool 1 thereto or therefrom, respectively. The generally wedge shaped-section is disposable between axially adjacent parts 16 and 17 of the coiled strip 14 at a position spaced from each end thereof for axially expanding the keyring coil 2 to facilitate connection and disconnection of keys thereto and therefrom.

13 Claims, 1 Drawing Sheet

KEYRING TOOL

BACKGROUND OF THE INVENTION

1. Field of the Invention

The present invention relates to a keyring tool suitable for use in facilitating connection and disconnection of keys to expansion coil type keyrings.

Expansion coil type keyrings provide a very simple and secure means of storing a number of keys. The connection and disconnection of keys to and from such keyrings does however present practical problems insofar as expansion of the keyring coil may require a significant amount of force which is at the same time somewhat difficult to apply. If a user attempts to expand the coil with a finger nail then this may suffer damage or injury. On the other hand suitable mechanical tools which might be used for this end are often not available to hand.

2. Prior Art

Typical mechanical tools are disclosed in U.S. Pat. No. 5,373,717 (GORE et al), U.S. Pat. No. 4,719,778 (MURPHY et al), U.S. Pat. No. 4,706,477 (ROUSSEAU), U.S. Pat. No. 4,325,273 (GIBBONS) and GB 2,175,532 (Van METER). Gore et al discloses a keyring splitter provided with a wedge shaped feature, whereupon a conventional keyring is pulled over and split apart using the wedge shaped feature. The keyring is split apart by a fixed amount which is determined by the width of the wedge shaped portion. Murphy et al discloses a planar keyring separator provided with a generally triangular projection with an apex formed and arranged to be inserted and pushed in between the coils of a keyring thus separating the coils. The keyring separator can only open the keyring by a preset fixed amount. The keyring device disclosed by Rousseau similarly can only open a keyring by a fixed, preset amount and operates by pushing the keyring onto a pointed tool component to effect separation of the coils of the keyring. Gibbons discloses an opener wherein in use of the opener coils of a keyring are split apart by inserting a pointed wedge portion of the opener between the coils and pushing the opener from an inside direction towards the outside of the ring. Van Meter discloses a keyring attachment which has a protrusion integrally attached to a body section. In use, the protrusion is pushed between the coils of a keyring and turns the body section against the protrusion to open out the coils. The keyring attachment allows the keyring coils to be separated by a fixed amount only.

It is an object of the present invention to avoid one or more of the disadvantages of the prior art and to provide a key ring tool that is simple and convenient to use and which can be retained on a keyring for such use.

SUMMARY OF THE INVENTION

The present invention provides a keyring tool suitable for storage on an expandable coil-type keyring and disconnection therefrom for use in connecting and disconnecting keys to and from said keyring, and comprising a bow portion for connection of the tool to the keyring, said bow portion having at least one circumferentially extending portion having a generally wedge shaped-section extending from one side of said circumferentially extending portion towards an opposite side thereof for insertion between one end of the coiled strip of the keyring coil and an axially adjacent part of said coiled strip for threading of said strip through said bow portion for connection or disconnection of the keyring tool thereto or therefrom, respectively, said generally wedge shaped-section being disposable between axially adjacent parts of the coiled strip at a position spaced from each end thereof for axially expanding said keyring coil to facilitate connection and disconnection of keys thereto and therefrom.

Advantageously the keyring tool has an elongate blade portion extending from said bow portion as this allows ready withdrawal of the blade portion between the axially spaced adjacent parts of the coiled strip. This form of tool is also easier to manipulate when it is being used to axially expand the keyring coil for key connection and disconnection.

In another aspect, the present invention provides a keyring tool suitable for storage on an expandable coil-type keyring and disconnection therefrom for use in connecting and disconnecting keys to and from said keyring, and comprising a bow portion for connection of the tool to the keyring and a blade portion, said bow portion having at least one circumferentially extending portion having a generally wedge shaped-section extending from one side of said circumferentially extending portion towards an opposite side thereof for insertion between one end of the coiled strip of the keyring coil and an axially adjacent part of said coiled strip for threading of said strip through said bow portion for connection or disconnection of the keyring tool thereto or therefrom, respectively, said blade portion having a generally wedge shaped-section for insertion between a said one end of the coiled strip and an axially adjacent part of the coiled strip for axially expanding said keyring coil to facilitate connection and disconnection of keys thereto and therefrom.

Thus with a keyring tool of the invention the tool is always readily available to hand, being stored on the keyring itself, and enables the keyring coil to be readily expanded when required to enable easy connection or disconnection of keys to and from the key ring.

The bow portion of the keyring tool generally comprises a substantially planar ring member which may be more or less rounded or polygonal in outline with an aperture therethrough, through which aperture the strip of the keyring coil may be threaded. The wedge-shaped section of said circumferentially extending portion of the bow portion may extend generally orthogonally with respect to the principal plane of the bow portion from one axial side or face to the opposite axial side or face thereof. Alternatively the wedge-shaped section may extend substantially in the plane of the bow portion from a radially outward side towards a radially inward side thereof. In the former case a single wedge-shaped section may be used for both connection and disconnection to and from the keyring, the tool being simply flipped over to change from connection to disconnection disposition. In the latter case a further wedge-shaped section extending in the radially opposite sense is required with the one tapering outwardly of the bow portion being used for connection and the one tapering inwardly of the bow portion for disconnection.

The tool may be made of any reasonably durable and strong, substantially rigid material which can resist the forces exerted on it by the coil strip during expansion of the keyring coil. Conveniently it may be made of metal, e.g. steel, brass, or some other alloy, or a plastics material such as polyamide.

The tool may be made in any convenient size but conveniently is dimensioned generally similarly to a cylinder lock key with a thickness of the order of 1 to 4 mm, preferably from 2 to 3 mm.

The blade portion may be of any convenient shape and size. Conveniently the blade portion is generally similar to the shank and bit portion of a cylinder lock-type key i.e. generally elongate and tapering towards its distal end.

Further preferred features and advantages of the invention will appear from the following detailed description given by way of example of a preferred embodiment illustrated with reference to the accompanying drawings in which:

DETAILED DESCRIPTION OF THE DRAWINGS

Figure 1:
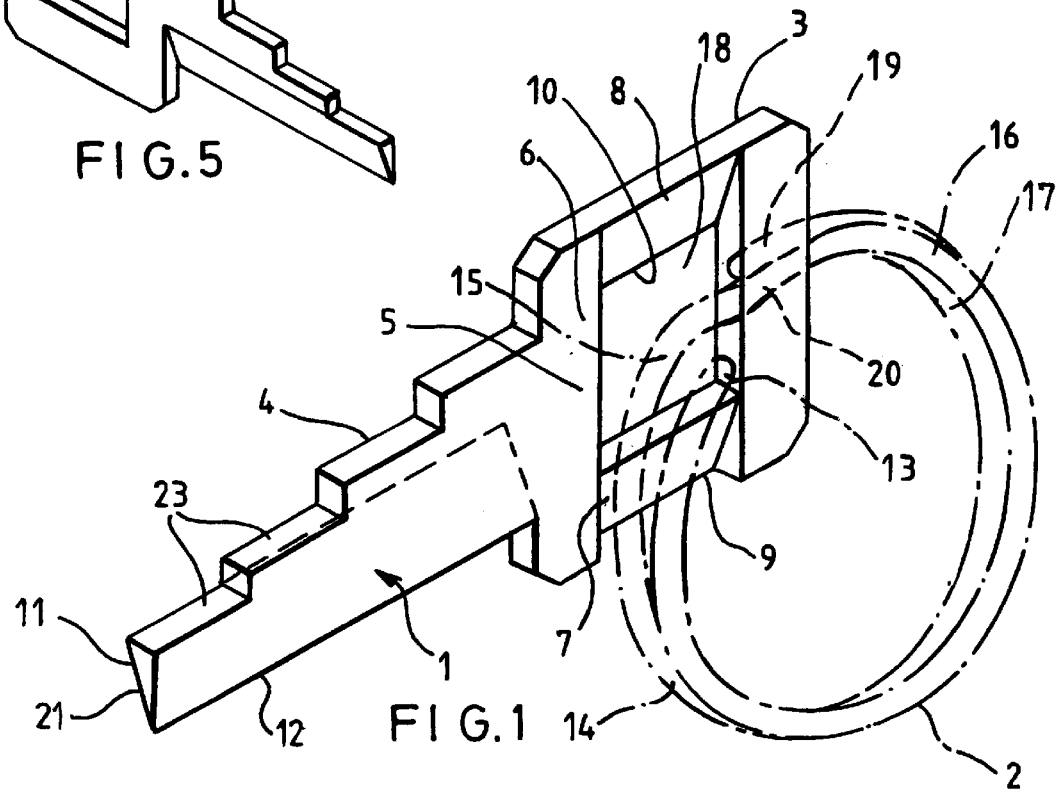
FIG. 1 is a perspective view of a keyring tool of the invention in the process of being connected to a keyring.

FIG. 1 shows a keyring tool 1 of the invention in the process of being connected to a keyring 2. The tool 1 is generally in the shape of a cylinder lock-type key with a generally square bow portion 3 and a blade portion 4 corresponding to a shank/bit portion of a key, extending from a first circumferential portion 5 forming a first side 6 of the bow portion 3. The bow portion 3 has second and third circumferential portions 7, 8 at either side of said first circumferential bow portion 6 and each having a wedge-shaped section extending in the plane of the bow portion 3. The wedge-shaped section of the second circumferential portion 7 extends from its leading edge 9 radially inwardly while that of the third circumferential portion 8 extends from its leading edge 10 radially outwardly of the bow portion.

The blade portion 4 has an elongate wedge-shape section portion 11 presenting a knife edge 12 alongside one edge of the blade portion 4.

The keyring tool 1 is conveniently stored on the keyring 2 and may be connected thereto by inserting the leading edge 9 of the second circumferential portion 9 between one end 13 of the coiled strip 14 constituting the keyring coil 2 and an adjacent portion 15 of the strip 14, and then progressively feeding said wedge-shaped section circumferential portion 9 between the adjacent turns 16, 17 of the keyring coil 2 so as to axially expand the latter. The strip end 13 is then fed through the central aperture 18 of the bow portion 3 until said circumferential portion 8 emerges from between the adjacent coil turns 16,17 at the other end 19 of the strip 14.

In order to disconnect the tool from the keyring the leading edge 10 of the third circumferential portion 8 is fed between one or other end 13, 19 of the coiled strip 14 and an adjacent strip portion 15, 20 and a similar procedure followed.

In use of the tool 1 the knife-edge 12 of the blade portion 4 is inserted between an end 13, 19 of the coiled strip 14 and then moved along between the adjacent coil turns 16, 17 so as to axially expand the keyring coil 2 adjacent said end 13, 19 so that a circumferential portion of the bow of a key (not shown) to be connected or disconnected from the keyring may be easily introduced in between the adjacent coil turns 16, 17 and then in due course fed around the keyring coil 2 to the other end 19, 13 of the coiled strip 14 thereby to connect or disconnect the key to or from the keyring. Once the circumferential portion of the key bow portion has been introduced between the coil turns 16, 17 then the blade portion 4 is no longer required for expansion of the keyring coil and may be withdrawn.

Figure 2:
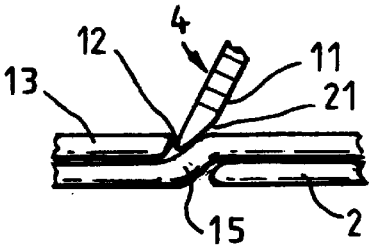
FIG. 2 is a partial side view of a key ring showing insertion of the tool blade portion.
Figure 3:
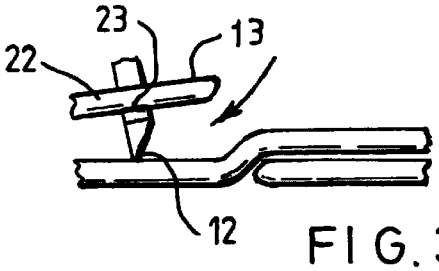
FIG. 3 is a similar view to FIG. 2 showing use of the blade portion to axially expand the key ring for connection of a key.

FIG. 2 shows the knife edge 12 of the wedge-shape section portion 11 of the blade portion 4 of the tool of FIG. 1 being inserted between one end 13 of the coiled strip 14 of a clockwise extending keyring coil 2 and an adjacent coiled strip portion 15, with the inclined face 21 engaging the latter. (Incidentally it will be appreciated that keyrings may be of either hand i.e. clockwise or anti-clockwise extending, and the wedge-shaped sections are preferably used in the way shown in FIG. 2—i.e. rather than with the non-inclined face against said adjacent coiled strip portion 15. Of course the wedge shaped portion could be formed and arranged so that both its opposite faces taper inwardly towards each other.) The blade portion 4 is then fed along with its knife-edge 12 leading, between the adjacent coiled strip portions for some distance. The blade portion 4 is then twisted through about 90° as shown in FIG. 3 to axially expand the coiled strip 14 to allow a key to be freely threaded onto the now freely spaced coiled strip end 13. As may be seen in FIG. 3 the raised coiled strip portion 22 rests on the selected flat edge 23, opposite the knife edge 12, of the blade portion 4 (see also FIG. 1) so that the blade portion 4 is held in position by the resilient biasing force of the coiled strip without the need for the user to hold the twisted position, thereby facilitating connection (and disconnection).

As noted above a series of flat blade portion edges 23 at different spacings from the knife edge 12, is provided to provide different degrees of axial expansion to suit different sizes of keying, different sizes of key bow portion, etc.

Figure 4:
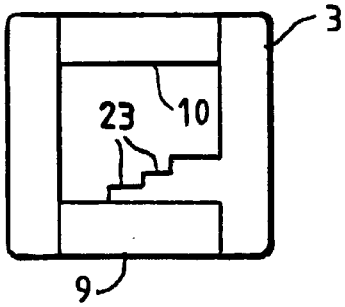
FIG. 4 is a plan view of another embodiment.

FIG. 4 shows another tool of the invention in which no projecting blade portion is provided, there being used instead that one 7 of the wedge shaped portions of the bow portion 3 of the tool itself which has its knife-edge 9 at the outside of the bow portion 3, for axially expanding the keying coil 2 for connection or disconnection of keys.

Figure 5:
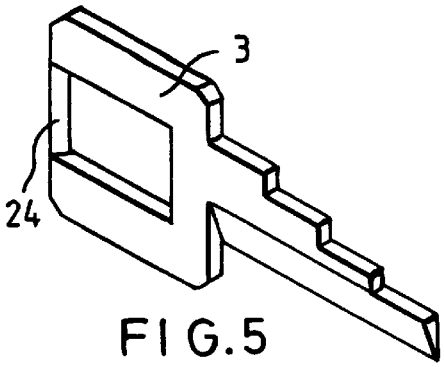
FIG. 5 is a perspective view of a further embodiment.

FIG. 5 shows another embodiment in which the bow portion 3 of a tool of the invention has a single wedge-shape section bow portion 24 which tapers in a direction generally orthogonally of the principal plane of the tool and can be used for both connection and disconnection of the tool to a keyring 2. It will be appreciated that in order to provide adequate strength for this portion it will generally be desirable to use a somewhat thicker plate than that from which the tools of FIGS. 1 to 4 are formed.

What is claimed is:

1. A keyring tool suitable for storage on an expandable coil-type keyring and disconnection therefrom for use in connecting and disconnecting keys to and from said keyring, and comprising a bow portion for connection of the tool to the keyring, said bow portion having at least one circumferentially extending portion having a generally wedge shaped-section extending from a leading edge portion at one side of said circumferentially extending portion towards a stop face at an opposite side thereof, for insertion between one end of the coiled strip of the keyring coil and an axially adjacent part of said coiled strip for threading of said strip through said bow portion for connection or disconnection of the keyring tool thereto or therefrom, respectively, said leading edge portion further being advancable from said one end of said coiled strip into a position between first and second axially adjacent parts of the coiled strip, said position being spaced from each end for axially expanding said keyring coil to a first axial expansion level, said tool then being twistable about a transverse axis extending between said first and second parts of the coiled strip so as to bring said leading edge portion and said stop face into engagement with respective ones of said first and second axially adjacent parts of the coiled strip so as to further expand axially said keyring coil to a second axial expansion level, and retain said keyring coil at said second expansion level, thereby to facilitate connection and disconnection of keys thereto and therefrom.

2. A keyring tool suitable for storage on an expandable coil-type keyring and disconnection therefrom for use in connecting and disconnecting keys to and from said keyring, and comprising a bow portion for connection of the tool to the keyring and a blade portion, said bow portion having at least one circumferentially extending portion having a generally wedge shaped-section extending from a first leading edge portion at one side of said circumferentially extending portion towards a stop face at an opposite side thereof, for insertion between one end of the coiled strip of the keyring coil and an axially adjacent part of said coiled strip for threading of said strip through said bow portion for connection or disconnection of the keyring tool thereto or therefrom, respectively, said blade portion having a generally wedge shaped-section provided with a second leading edge portion at one side thereof and extending towards a stop face at an opposite side thereof, said second leading edge portion further being advancable from said one end of said coiled strip into a position between a said one end of the coiled strip and an axially adjacent part of the coiled strip for axially expanding said keyring coil to a first axial expansion level, said tool then being twistable about a transverse axis extending between said first and second parts of the coiled strip so as to bring said leading edge portion and said stop face into engagement with respective ones of said first and second axially adjacent parts of the coiled strip so as to further expand axially said keyring coil to a second axial expansion level, and retain said keyring coil at said second expansion level, thereby to facilitate connection and disconnection of keys thereto and therefrom.

3. A keyring tool according to claim 1 wherein said bow portion comprises a substantially planar ring member which is rounded or polygonal in outline with an aperture therethrough, where in use, said strip of the keyring coil is passed and threaded through said aperture.

4. A keyring tool according to claim 1 wherein said wedge-shaped section tapers in a direction generally orthogonal with respect to the principal plane of the bow portion from one axial side or face to the opposite axial side or face thereof.

5. A keyring tool according to claim 1 wherein said wedge-shaped section extends substantially in the plane of the bow portion which tapers from a radially outward side towards a radially inward side thereof.

6. A keyring tool according to claim 1 wherein there is provided a further wedge-shaped section circumferential portion which has a leading edge which extends radially from the inside or outside of said bow portion oppositely with respect to the first said wedge-shaped section.

7. A keyring tool according to claim 2, wherein said blade portion is generally elongate and tapers towards its distal end.

8. A keyring tool according to claim 2 wherein said bow portion comprises a substantially planar ring member which is rounded or polygonal in outline with an aperture therethrough, where in use, said strip of the keyring coil is passed and threaded through said aperture.

9. A keyring tool according to claim 2 wherein said wedge-shaped section tapers in a direction generally orthogonal with respect to the principal plane of the bow portion from one axial side or face to the opposite axial side or face thereof.

10. A keyring tool according to claim 2 wherein said wedge-shaped section extends substantially in the plane of the bow portion from a radially outward side towards a radially inward side thereof.

11. A keyring tool according to claim 2 wherein there is provided a further wedge-shaped section circumferential portion which has a leading edge which extends radially from the inside or outside of the bow portion oppositely with respect to the first said wedge-shaped section.

12. A keyring tool according to claim 1 wherein the wedge-shaped section is provided with at least two said stop faces wherein each of said stop faces is distanced by a different amount from said leading edge of said wedge-shaped section for axially displacing to different axial expansion levels said first and second axially adjacent portions of the keyring coil.

13. A keyring tool according to claim 2 wherein said blade portion is provided with at least two said second stop faces wherein each of said second stop faces is distanced by a different amount from said second leading edge of the blade portion for axially displacing to different axial expansion levels said axially adjacent portions of the keyring coil.

* * * * *